US006267616B1

(12) United States Patent
Sakatani et al.

(10) Patent No.: US 6,267,616 B1
(45) **Date of Patent: *Jul. 31, 2001**

(54) PRESSURE CONTACT CONNECTOR

(75) Inventors: Atsushi Sakatani; Yasushi Okayasu, both of Yokkaichi (JP)

(73) Assignee: Sumitomo Wiring Systems Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/198,343

(22) Filed: Nov. 24, 1998

(30) Foreign Application Priority Data

Dec. 26, 1997 (JP) ..... 9-359917

(51) Int. Cl.[7] ..... H01R 4/24
(52) U.S. Cl. ..... 439/397; 439/749; 439/404
(58) Field of Search ..... 439/748, 749, 439/397, 398, 400, 404, 405, 417, 744, 745, 746, 747

(56) References Cited

U.S. PATENT DOCUMENTS

| | | | | |
|---|---|---|---|---|
| 2,979,689 | * | 4/1961 | Jackson et al. | 439/744 |
| 3,566,342 | | 2/1971 | Schmitt et al. . | |
| 3,853,388 | * | 12/1974 | Heimbrock | 439/749 |
| 3,976,348 | | 8/1976 | Simmons . | |
| 3,992,072 | | 11/1976 | Anhalt et al. . | |
| 4,159,158 | | 6/1979 | Weidler . | |
| 4,220,388 | * | 9/1980 | Dechelette | 439/748 |
| 4,701,004 | * | 10/1987 | Yohn | 439/744 |
| 4,781,628 | | 11/1988 | Detter et al. . | |
| 5,108,318 | * | 4/1992 | Sakurai et al. | 439/744 |
| 5,489,223 | * | 2/1996 | Faje et al. | 439/748 |
| 5,624,273 | * | 4/1997 | Myer | 439/748 |
| 5,634,825 | * | 6/1997 | Maki | 439/748 |
| 5,695,368 | | 12/1997 | Joly et al. . | |
| 5,934,945 | * | 8/1999 | Petersen et al. | 439/744 |
| 5,984,736 | | 11/1999 | Sakurai et al. . | |

FOREIGN PATENT DOCUMENTS

| | | |
|---|---|---|
| 19628116 | 10/1997 | (DE) . |
| 079 599 | 5/1983 | (EP) . |
| 321 285 | 6/1989 | (EP) . |
| 1497274 | 1/1978 | (GB) . |
| 60-240072 | 11/1985 | (JP) . |
| 62-198063 | 9/1987 | (JP) . |
| 6-89748 | 3/1994 | (JP) . |
| 6-215809 | 8/1994 | (JP) . |

* cited by examiner

*Primary Examiner*—Gary F. Paumen
*Assistant Examiner*—Alexander Gilman
(74) *Attorney, Agent, or Firm*—Banner & Witcoff, Ltd.

(57) ABSTRACT

A pressure contact terminal fitting 20 is inserted into a terminal housing chamber until it reaches the correct position, whereupon two protruding members 26 and 29 formed on the terminal fitting 20 make contact with corresponding receiving members 18 and 16. In this way, a pushing force exerted by an electric wire on a pressure contact member 24 is resisted by the receiving members 18 and 16. Resistance to bending is increased, and the contact portion opposite the pressure contact member 24 is relieved of axial load during the wire connection step.

9 Claims, 6 Drawing Sheets

PRESSURE CONTACT CONNECTOR

TECHNICAL FIELD

The present invention relates to a pressure contact electrical connector.

BACKGROUND TO THE INVENTION

FIG. 9 shows a conventional pressure contact connector 6 comprising a connector housing 1, and a female pressure contact terminal fitting 2 housed in a terminal housing chamber 3 formed within the connector housing 1. The terminal fitting 2 has a long and narrow box-shape, a resilient contact member 5 being formed on the anterior end thereof, the contact member 5 fitting together with a corresponding terminal fitting (not shown). A pressure contact blade 4 is provided on the posterior end of the pressure contact terminal fitting 2, an insulated electric wire W fitting thereto.

The electric wire W is attached to the pressure contact terminal fitting 2 by an automated machine. That is, the insulated wire W is pressed by a pressing means (not shown) of an automated machine onto the pressure contact blade 4, the blade 4 and wire W accordingly becoming electrically connected. In practice, an anterior face of the housing is placed against a receiving face 9 of the automated machine, and a pressing force from the automated machine acts upon the posterior end face of the pressure contact terminal fitting 2 in the direction of arrow A, this force passing through the anterior face wall 3A of the terminal housing chamber 3 and being received and stopped by the receiving face 9. As a result, the pressure contact terminal fitting 2 is clamped between its anterior and posterior ends.

However, the pressure contact terminal fitting 2 has a long and narrow shape in the anterior-posterior direction.. Consequently, in the case where the pressing force from the automated machine is high, there is the possibility that the pressure contact terminal fitting 2 could change shape and bend inside the chamber 3.

The present invention has been developed after taking the above problem into consideration, and aims to present a pressure contact terminal fitting which does not bend when the wire is pushed into the blade 4.

SUMMARY OF THE INVENTION

According to the invention there is provided an electrical connector comprising a housing, a chamber in the housing, and an elongate pressure contact terminal fitting insertable within said chamber along an axis thereof, one end of said fitting having a slot extending in the direction of said axis, said slot defining a pressure contact blade for connection to an electric wire, and the other end of said fitting comprising a terminal for connection to a mating terminal fitting, wherein a mid-portion of said fitting has outwardly extending abutments on opposite sides thereof, said abutments being engageable with corresponding steps in the wall of said chamber, and resisting end loads applied to said one end along said axis.

The abutments preferably lie in a common plane perpendicular to said axis, and comprise an outward protrusion or a step of said terminal. The terminal may include a retaining lance engageable with one side of an inner projection of said chamber, the other side of said projection being engageable by one of said abutments.

BRIEF DESCRIPTION OF DRAWINGS

Other aspects of the invention will be apparent from the following description of a preferred embodiment shown by way of example only in the accompanying drawings in which.

DESCRIPTION OF PREFERRED EMBODIMENT

Figure 1:
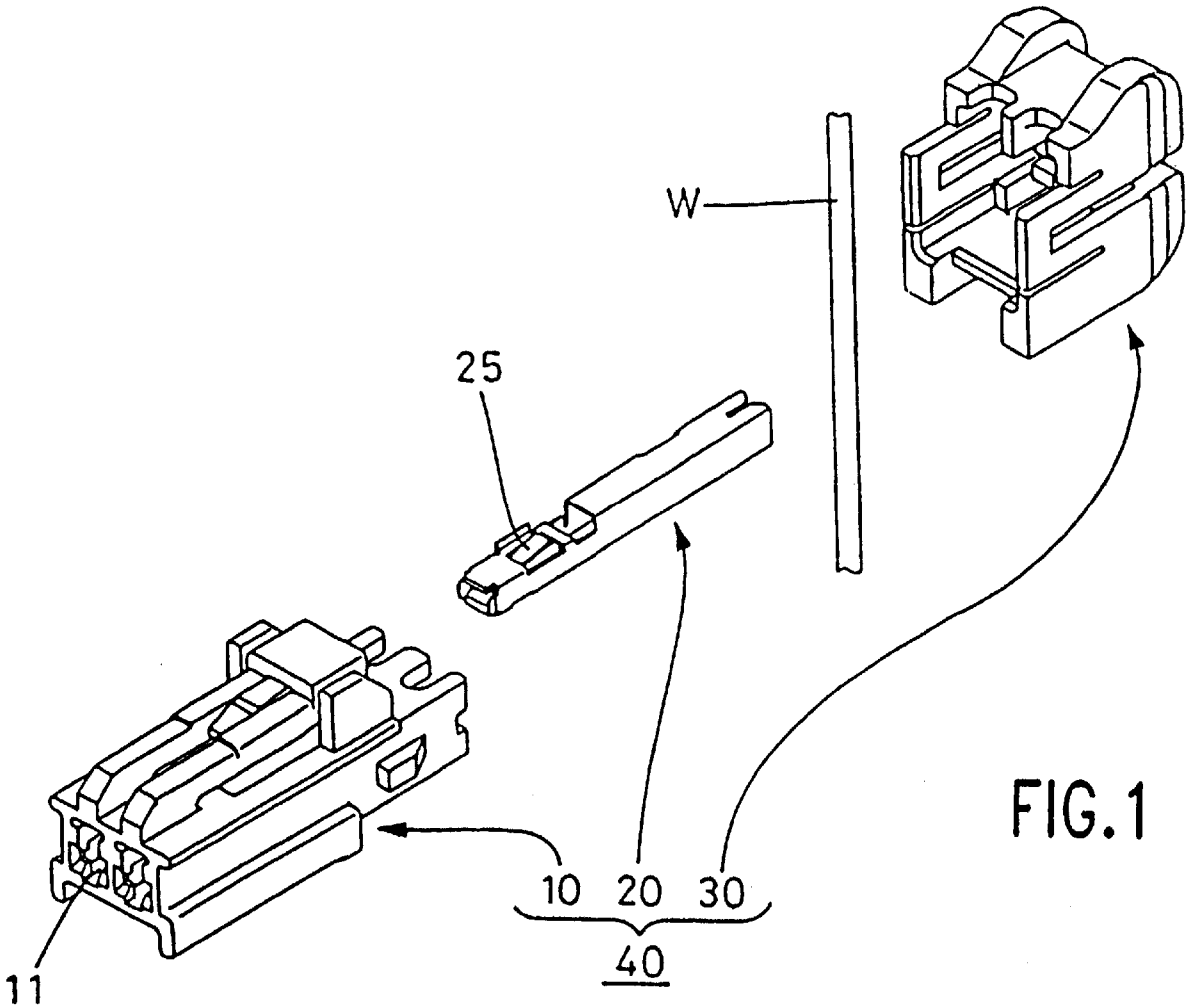
FIG. 1 is a diagonal view of a pressure contact connector according to the invention prior to being fitted together.
Figure 2:
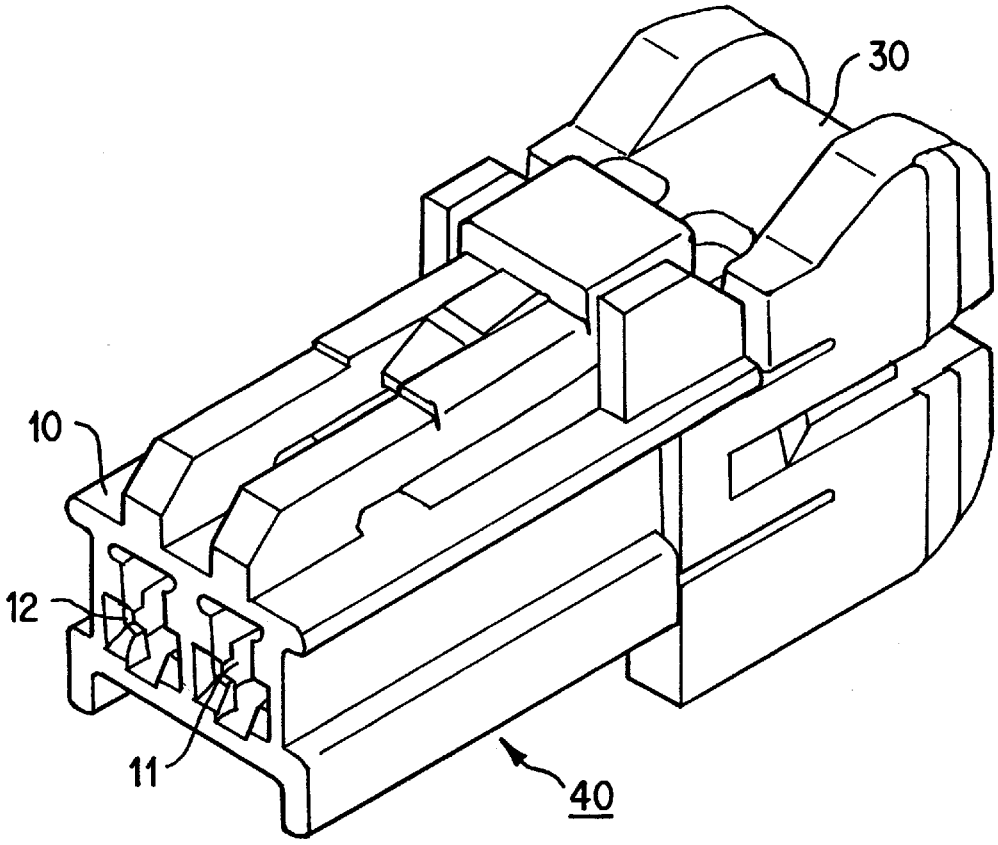
FIG. 2 is a diagonal view of the pressure contact connector after being fitted together.
Figure 3:
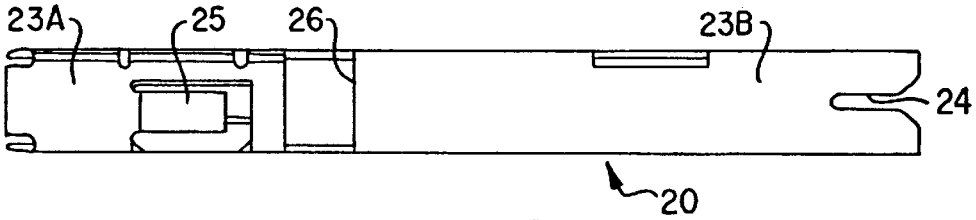
FIG. 3 is a plan view of the pressure contact terminal fitting.
Figure 4:
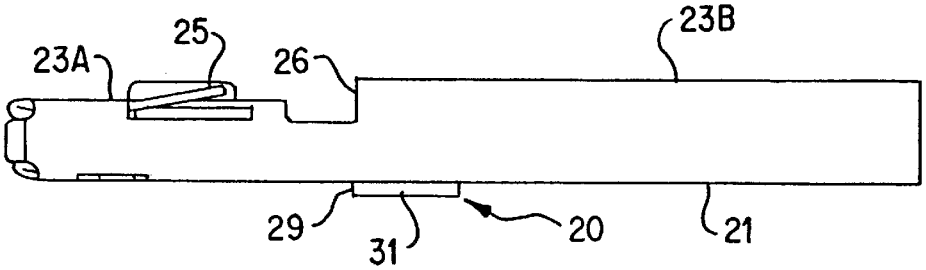
FIG. 4 is a side view of the pressure contact terminal fitting.
Figure 5:
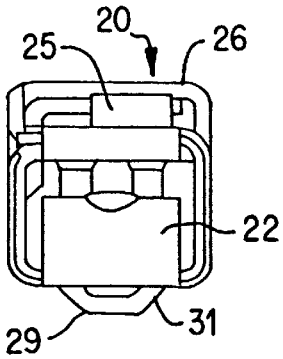
FIG. 5 is a front view of the pressure contact terminal fitting.
Figure 6:
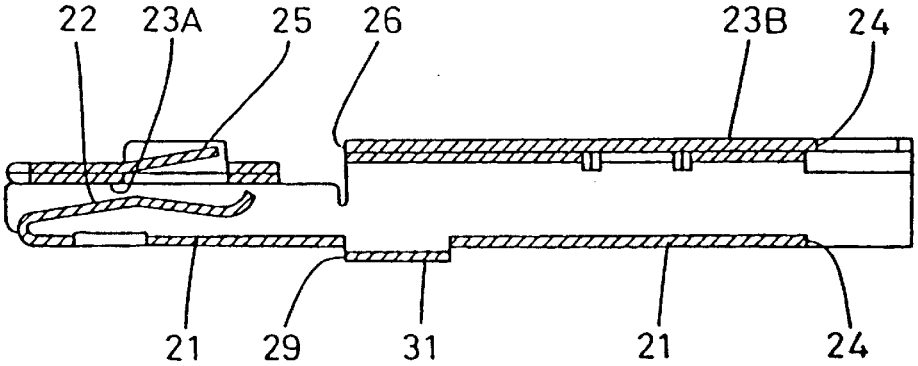
FIG. 6 is a side cross-sectional view of the pressure contact terminal fitting.
Figure 7:
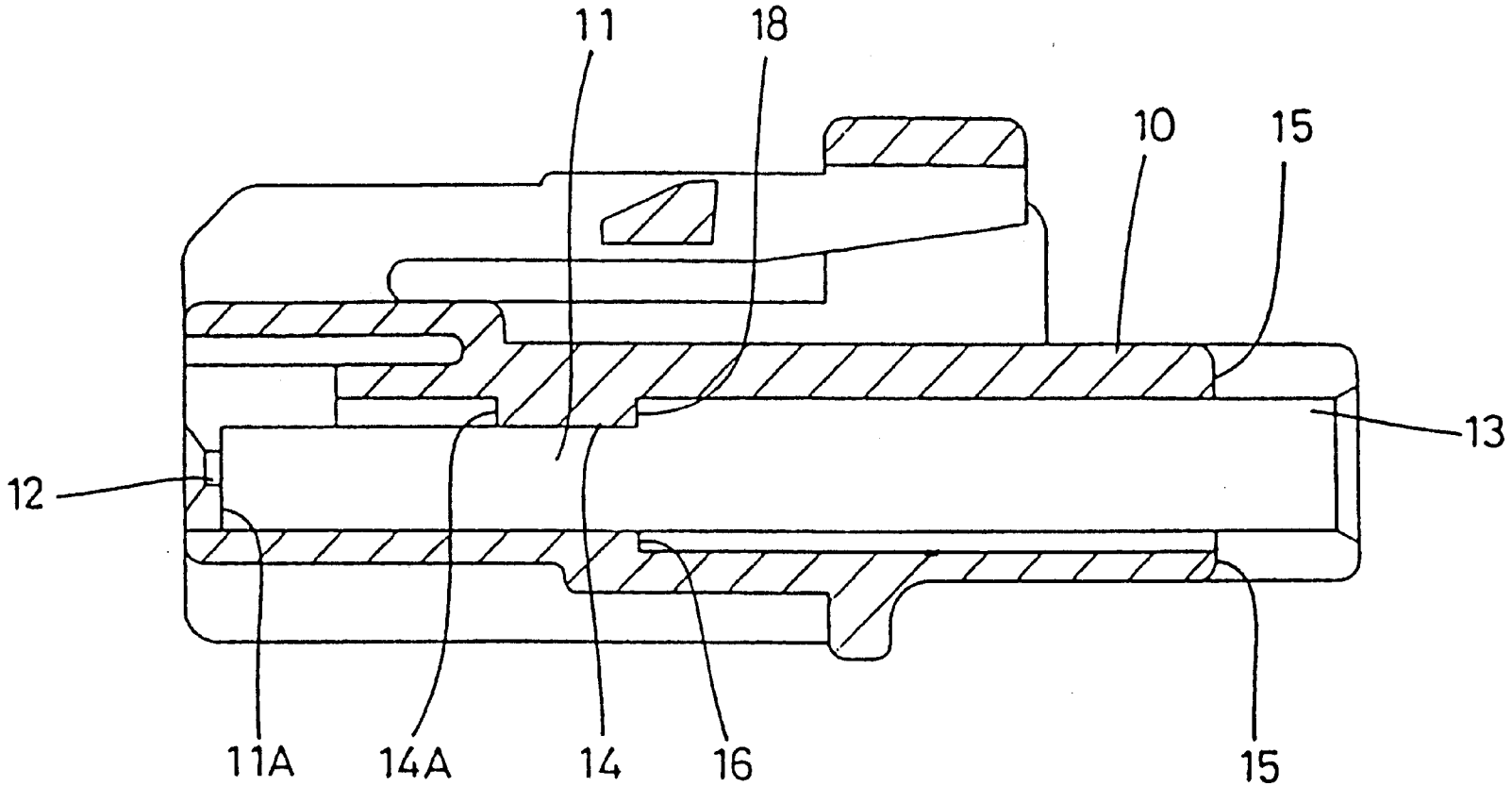
FIG. 7 is a side cross-sectional view of the connector housing.

An embodiment of the present invention is explained below with the aid of FIGS. 1 to 8.

A pressure contact connector 40 has a connector housing 10, a female pressure contact terminal fitting 20 housed within the connector housing 10, and a cover 30 which covers the posterior portion of the connector housing 10. In the present embodiment, the anterior face of the pressure contact connector 40 is that face which fits together with a corresponding connector (not shown).

As shown in FIGS. 3 to 6, the pressure contact terminal fitting 20 has a long and narrow angular tubular shape in an anterior-posterior direction. A resilient contact member 22 is formed on the anterior end portion of the pressure contact terminal fitting 20 by bending inwards a protruding portion of an anterior edge of a lower face 21. A tab of a male terminal fitting (not shown) is held resiliently between the resilient contact member 22 and an anterior upper face 23A, thereby bringing the male and female terminal fittings into an electrically connected state.

At the posterior end portion of the pressure contact terminal fitting 20 a posterior upper face 23B and the lower face 21 are opened out on their left and right posterior ends to form a cut-away pressure contact member 24. This pressure contact member 24 corresponds to an electric wire receiving member 15 (to be explained later) of the connector housing 10. The insulated electric wire W is joined to the pressure contact member 24 by pushing in a posterior direction, cutting through the insulation thereof and bringing the core wire into contact with the pressure contact member 24.

A lance 25, formed by bending, protrudes diagonally upwards at the anterior upper face 23A of the terminal fitting 20. When the terminal fitting 20 has been inserted into the correct position of the terminal housing chamber 11, this lance 25 is engaged by a stopping face 14A (to be described later), and maintains the terminal fitting 20 in a retained state.

Further, to the posterior of the lance 25, the posterior upper face 23B rises to a specified height higher than the anterior upper face 23A, the boundary between the two plates constituting a step. The anterior edge portion of this step comprises a first protruding member 26. The height of the step between the first protruding member 26 and the anterior upper face 23A corresponds to the protruding height of a stopping protrusion 14 of the terminal housing chambers 11. The first protruding member 26 is formed by folding the end face of the posterior upper face 23B into a double layer.

Further, two slits are cut into the lower face 21 in the width-wise direction of the pressure contact terminal fitting 20, one slit being located close to the first protruding member 26 and the second slit being located somewhat posterior thereto. The portion between these is pushed out in a downwards direction from the lower face 21 to form a bridge-shaped protrusion 31, the anterior end of the bridge-shaped protrusion 31 comprising a second protruding member 29.

The connector housing 10 is molded from synthetic resin and, typically has a plurality of terminal housing chambers 11 are formed in a parallel manner on the right and left therein, the anterior and posterior faces of these terminal housing chambers 11 being open, and each terminal housing chamber 11 housing a pressure contact terminal fitting 20. The anterior openings of the chambers 11 form tab insertion holes 12 into which tabs of a corresponding male terminal fitting (not shown) are inserted, and the posterior openings of the chambers 11 form insertion holes 13 into which the terminal fittings 20 are inserted.

The stopping protrusion 14 protrudes from the central portion of the upper face of each chamber 11. The anterior and posterior faces of the stopping protrusion 14 are approximately perpendicular relative to the upper wall face of the chambers 11, the anterior face thereof comprising the stopping face 14A. The lance 25 of the terminal fitting 20 is engaged by this stopping face 14A, thereby retaining the terminal fitting 20 inside the chamber 11. The posterior face of the stopping protrusion 14 comprises a first receiving member 18, this being capable of receiving and resisting the pushing force of the terminal fitting 20 by making contact with the first protruding member 26.

Further, a portion of the lower face of each chamber 11 forms a step-shaped portion, this portion being directly beneath the first receiving member 18. This step-shaped portion is formed by making the height of the lower face anterior to it higher than the height of the part of the lower face posterior to it. The step formed at the junction of these two differing heights constitutes a second receiving member 16. This second receiving member 16 is capable of receiving and resisting the pushing force of the terminal fitting 20 by making contact with the second protruding member 29.

The distance between the receiving members 18 and 16 and an anterior end face 11A of each chamber 11 is slightly greater than the distance between the protruding members 26 and 29 and the anterior end face 11A. Consequently, when the protruding members 26 and 29 are in a state in which they make contact with the receiving members 18 and 16, the anterior end face of the terminal fitting 20 and the anterior end face 11A of the chamber 11 do not make contact.

Portions of the upper and lower face of the posterior end of the connector housing 10 are cut-away in a schematic U-shape to form the electric wire receiving member 15. When the terminal fitting 20 is in an attached state within the terminal housing chamber 11, the electric wire W is held firmly by pressure contact inside this electric wire receiving member 15, and the insulated portion of the electric wire W is slit so that it is in electrical contact with the terminal fitting 20.

With the configuration as described above, the operation and effects of the present embodiment are explained hereinbelow.

Figure 8:
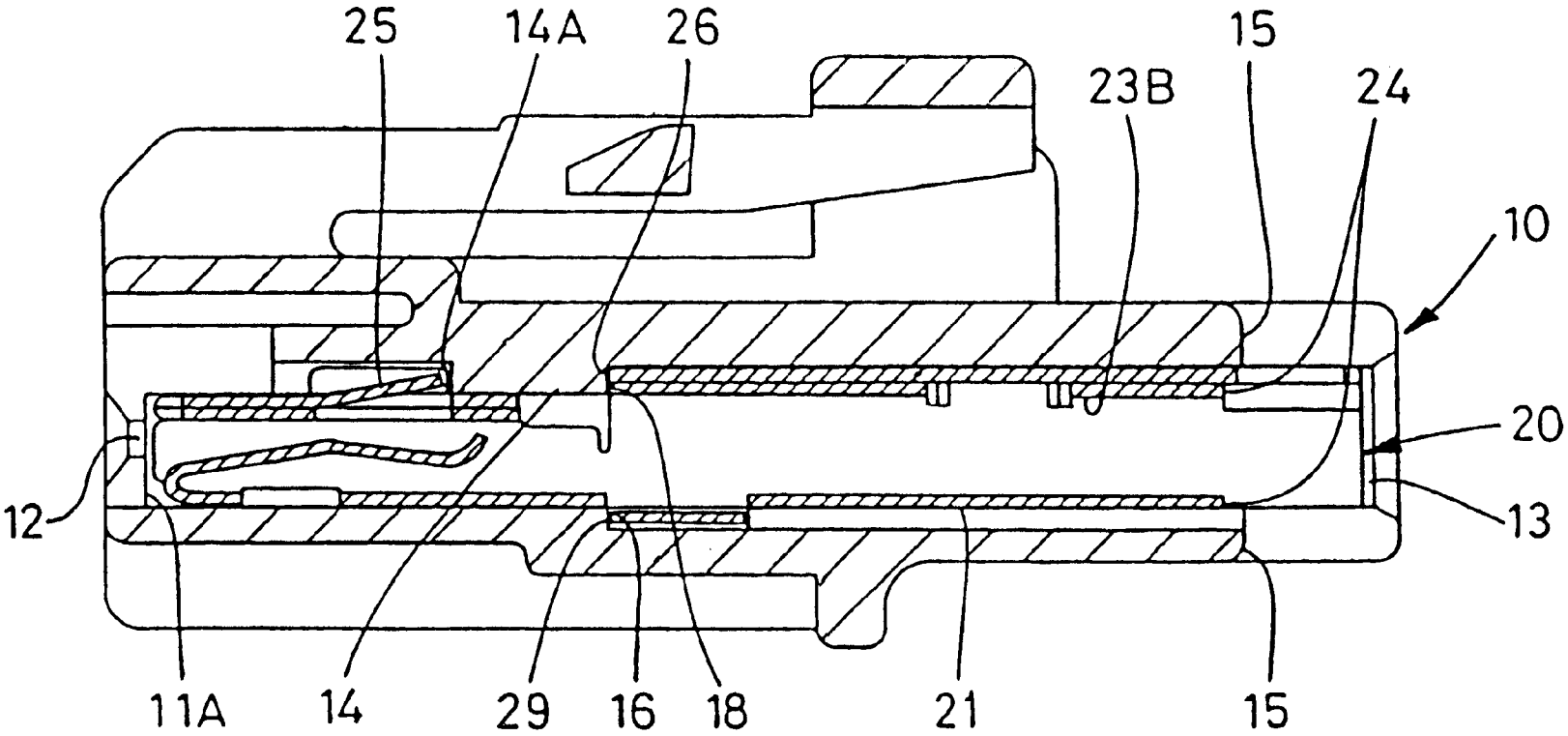
FIG. 8 is a ride cross-sectional view of the connector housing after the pressure contact connector has been attached thereto.
Figure 9:
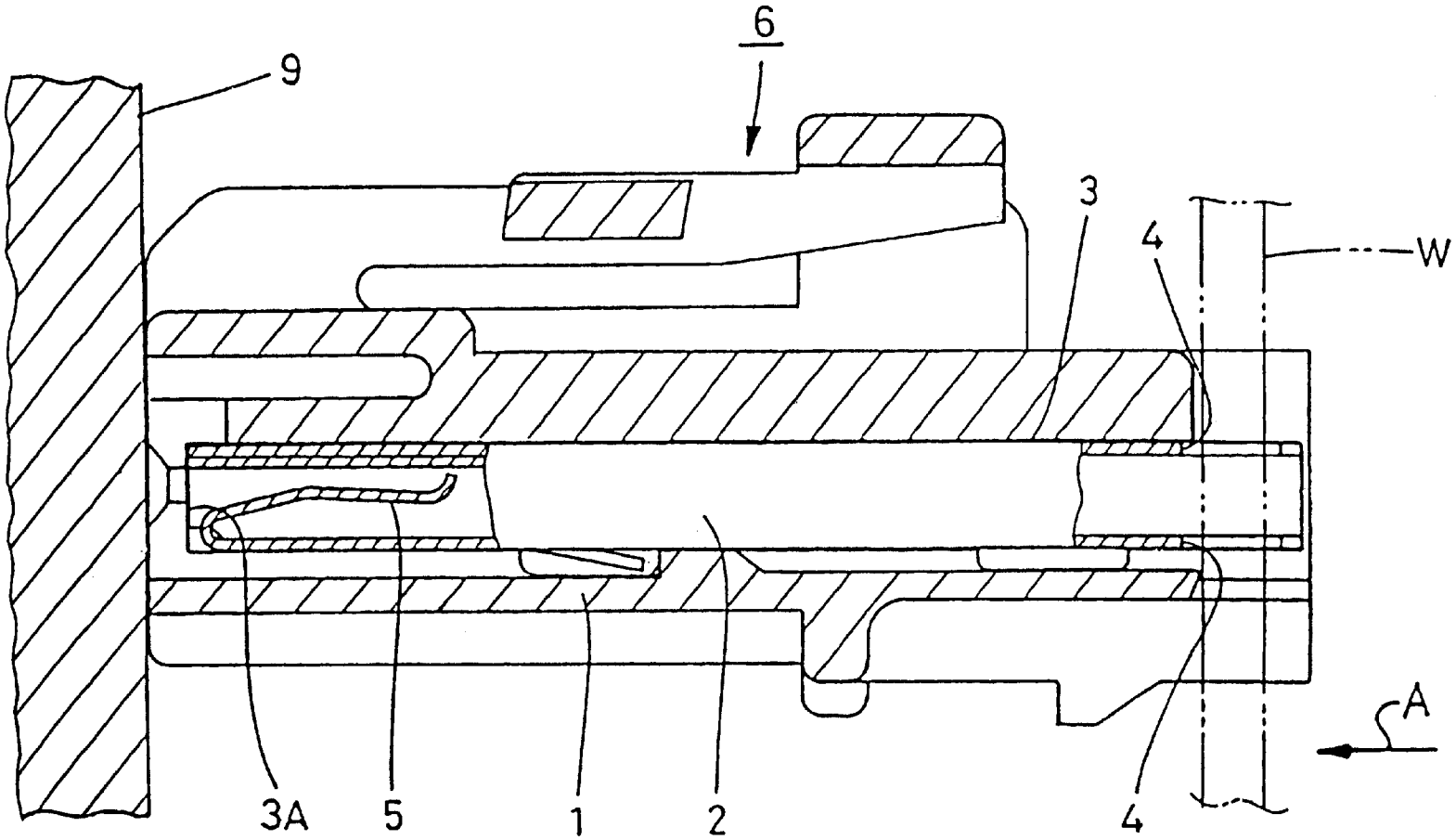
FIG.9 PRIOR ART
FIG. 9 is a side cross-sectional view of a prior art pressure contact connector.

First, the terminal fitting 20 is inserted into the chamber 11 until it reaches the correct position (see FIG. 8). At this juncture, the two protruding members 26 and 29 formed on the upper and lower faces of the terminal fitting 20 respectively make contact with the receiving members 18 and 16 in the chamber 11, thereby regulating the sliding of the pressure contact terminal fitting 20 in the anterior direction. Further, the lance 25 and the stopping face 14A mutually face one another at the anterior side of the stopping protrusion 14, thereby retaining the pressure contact terminal fitting 20.

Next, a pushing jig (not shown) is used to push the electric wire W in an anterior direction, the pressure contact member 24 cutting into the electric wire W, the core wire being brought into contact with the pressure contact member 24, and thereby achieving an electrically connected state. While this operation is being performed, the pushing force exerted on the pressure contact terminal fitting 20 by the pushing jig brings the protruding members 26 and 29 and the receiving members 18 and 16 into contact, thereby resisting movement of the terminal fitting 20 inside the connector housing 10, the terminal fitting 20 being clamped between the pressure contact member 24 and the receiving members 18 and 16.

In the present embodiment the pushing force is received by the receiving members 18 and 16, these being located on the central portion of the pressure contact terminal fitting 20 in a length-wise direction. As a result, the length of the terminal fitting 20 which it is clamped is shorter compared to the case where the pushing force is received at the anterior end of the terminal fitting 20, and rigidity is thereby increased. By this means, the bending of the pressure contact terminal fitting 20 as a result of a pushing force can be avoided. The male terminal contact area is also relieved of pushing loads.

It may appear that only one set among the protruding members 26 and 29 and receiving members 18 and 16 would be required to prevent the terminal fitting 20 from bending. However, for example, if only the first protruding member 26 and the first receiving member 18 were formed on the upper side of the terminal fitting 20, a downward force would act on the posterior portion of the terminal fitting 20 at the time when the wire W is pushed in, and there is the danger that the anterior portion of the terminal fitting 20 would move upwards as a result. In the present embodiment, the protruding members 26 and 29 and the receiving members 18 and 16 are located along the direction in which the wire W extends, and are formed on the upper and lower faces of the terminal fitting 20. This regulates the bending of the terminal fitting 20 along the direction in which the electric wire W extends, at the time when the wire W is pushed in. Furthermore, the lance 25 is provided on the side on which the first protruding member 26 is provided. As a result, the pressure contact connector 40 can be made smaller compared to a case in which a lance 25 is provided on a face not facing a receiving member (in the present embodiment, either the left or right face of the pressure contact terminal fitting 20).

The present invention is not limited to the embodiments described above with the aid of figures. For example, the possibilities described below also lie within the technical range of the present invention.

(1) In the present embodiment, an explanation has been given of a female pressure contact terminal fitting. However, the present invention is equally suitable for a male pressure contact terminal fitting inserted into a terminal housing chamber.

(2) In the present embodiment, the two sets of protruding members and receiving members are formed on the terminal housing chamber in approximately the same location relative to the length-wise direction of the terminal housing chamber. However, according to the present invention, the respective locations may be displaced with respect of each other.

(3) In the present embodiment, the stopping means for the pressure contact terminal fitting is a lance formed on this pressure contact terminal fitting, this lance being engaged by the stopping face of the terminal housing chamber. However, according to the present invention, the lance may equally well be formed on the terminal housing chamber and engaged by the terminal fitting.

What is claimed is:

1. An electrical connector comprising a housing, a chamber in the housing, and an elongate pressure contact terminal fitting insertable within said chamber along an axis thereof, a rearward end of said terminal fitting having a slot extending generally along said axis, said slot defining a pressure contact blade for direct connection to an electric wire, and a forward end of said terminal fitting comprising a terminal for connection to a mating terminal fitting, wherein a mid-portion of said terminal fitting has outwardly extending, forwardly facing abutments on opposite sides thereof, wherein a mid-portion of said chamber has inwardly extending, rearwardly facing steps which engage said abutments of the terminal fitting to resist end loads applied to said rearward end along said axis, wherein said rearward end of said terminal fitting includes axially extending sidewalls and wherein one of said abutments is formed at a front end of and in axial alignment with one of said sidewalls.

2. A connector according to claim 1 wherein one of said abutments comprises an outward protrusion on said terminal fitting terminal.

3. A connector according to claim 1 wherein one of said abutments comprises an outward protrusion of said terminal fitting.

4. A connector according to claim 1 wherein one of the steps of said chamber comprises an inwardly directed projection having an anterior face and a posterior face, said posterior face being engageable by one of said abutments of said terminal fitting, and said anterior face being engageable by a resilient retention member of said terminal fitting.

5. A connector according to claim 4 wherein said retention member is closer to said forward end of said terminal fitting than the abutments thereof.

6. A connector according to claim 1 wherein said abutments are in a common plane perpendicular to said axis.

7. A connector according to claim 6 wherein the distance between said abutments and said other end of said terminal fitting is adapted to give clearance between said other end and an end wall of said chamber.

8. A connector according to claim 1 and further including a cover attachable to said housing over said one end of said terminal fitting.

9. A connector according to claim 1 wherein the axial sidewalls form a substantially rectangular, box-shaped cross section.

* * * * *

UNITED STATES PATENT AND TRADEMARK OFFICE

CERTIFICATE OF CORRECTION

PATENT NO. : 6,267,616 B1
DATED : July 31, 2001
INVENTOR(S) : Atsushi Sakatani and Yasushi Okayasu It is certified that error appears in the above-identified patent and that said Letters Patent is hereby corrected as shown below:

Column 6, claim 4,
Lines 4-5, replace "one of said abutments of said" with -- an abutment of said --.

Signed and Sealed this

Twenty-sixth Day of February, 2002

*Attest:*

*Attesting Officer*

JAMES E. ROGAN
*Director of the United States Patent and Trademark Office*